United States Patent [19]

Oulsnam

[11] 4,214,532

[45] Jul. 29, 1980

[54] STEMMING

[75] Inventor: Bryon T. Oulsnam, Stoke-on-Trent, England

[73] Assignee: Coreplugs Limited, Stoke-on-Trent, England

[21] Appl. No.: 905,949

[22] Filed: May 15, 1978

[51] Int. Cl.[2] ..... F42D 1/08

[52] U.S. Cl. ..... 102/30; 102/23

[58] Field of Search ..... 102/21.4, 26, 30

[56] References Cited

FOREIGN PATENT DOCUMENTS 988763 4/1965 United Kingdom ..... 102/30

1150631 4/1969 United Kingdom ..... 102/30

OTHER PUBLICATIONS

Ritson et al., *Stemming Materials*, Safety in Mines Research Board Paper No. 84, His Majesty's Stationery Off. London, 1934 (pp. 16–30).

*Primary Examiner*—David H. Brown

*Attorney, Agent, or Firm*—Scrivener, Parker, Scrivener and Clarke

[57] ABSTRACT

In mining and quarrying an explosive charge is placed in a shot hole, and the subsequent explosion is contained by stemming. The invention provides stemming made from stemming plugs, each consisting of a self-supporting body made principally of sand bound with the aid of sodium silicate. The plugs are wetted, preferably by immersion in water, and inserted into the shot hole where they are crushed or disintegrated to form the stemming.

7 Claims, 2 Drawing Figures

STEMMING

Figure 1:
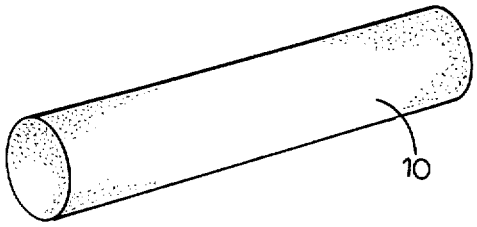

This invention relates to stemming, that is to material inserted into a shot hole in a mine or quarry, or elsewhere, in which an explosive charge has been placed, and serving to confine the explosion.

In the complete specification of our British Pat. No. 988 763 there is described stemming comprising crushed or disintegrated stemming plugs, each plug comprising a self-supporting body consisting at least principally of sand bound with the aid of sodium silicate. There are also described stemming plugs each comprising a self-supporting friable body consisting at least principally of sand bound with the aid of sodium silicate.

A difficulty that can arise with those stemming plugs is that if they are sufficiently friable to be readily crushed or disintegrated after they have been inserted into the shot holes, they are liable to be broken or even to disintegrate if they are subjected to rough treatment during transport. While it is still possible to crush or disintegrate stronger stemming plugs the crushing or disintegrating process is not always easy or reliable. The present invention provides a method enabling that difficulty to be reduced. The present invention also provides a new form of stemming.

From one aspect the present invention consists in a method of forming stemming, in which water is added to a stemming plug comprising a self-supporting body consisting at least principally of sand bound with the aid of sodium silicate, and the wetted plug is crushed or disintegrated when disposed in a shot hole.

From another aspect the present invention consists in stemming made by the method outlined in the last preceding paragraph.

In a preferred method of forming stemming the stemming plug is wetted before it is inserted into the shot hole. It has been found that the addition of water to a stemming plug causes the plug to become physically weaker and thus to become more readily crushed or disintegrated. It is thus possible to make stemming plugs that are relatively strong when dry, so that they are relatively resistant to accidental damage during transport, but that are capable of being readily crushed or disintegrated in the shot holes after they have been wetted.

Preferably the plug is wetted by being immersed in water or other aqueous liquid at least until no more water is absorbed by it. When a stemming plug is wetted by being immersed in water (or other aqueous liquid), normally it very quickly becomes fully soaked, so that to immerse a plug for a period of more than a few seconds does not cause the plug to absorb an increased amount of water. Thus in a preferred method the plug is immersed for only a short period of time. In theory, of course, it would be possible to wet the plug in such a manner that it absorbed less than the maximum possible amount of water, for example by wetting only part of the plug or by spraying the plug lightly with water. Although such procedures would bring about some weakening of the plug it is preferred to wet fully the whole plug.

Although the plug normally absorbs substantially the maximum possible amount of water during a short period of time, it is generally found that the plug becomes progressively weaker during a more extended period of time. For this reason it is preferred to allow a period to occur between the plug being wetted and it being crushed or disintegrated. The period may typically be a period of a few minutes' duration, and is preferably of at least two minutes duration. The weakening of the plug does not continue indefinitely, and it has been found that it is possible to make plugs that are weakened significantly within a few minutes but which still remain capable of being handled after a much longer period of time. Thus there is the greater practical advantage that the invention can be carried into effect without it being necessary to pay particular attention to time limits. For example, using a typical type of plug, the plug may be dipped in water for a few seconds, removed from the water, inserted into a shot hole and crushed two minutes later, or equally well a plug of that type may be immersed in water for a considerably longer period of time, removed from the water without it disintegrating, inserted into a shot hole and then crushed. When the second procedure is followed the plug is only a little less weak that it is when the first procedure is followed, but in each case the plug is noticeably weakened by its treatment with water.

The use of water enables the plugs to be weakened so that they can be readily and completely crushed or disintegrated in a shot hole. Normally no part of a plug retains its original shape when crushed. This fact, together with the presence of the water normally ensures that a good seal is formed in the shot hole.

The stemming plugs may be similar to those described in the complete specification of our aforementioned British Pat. No. 988 763, though the proportion of sodium silicate in the preferred plugs of the present invention may well be greater than the proportion in the preferred plugs described in that complete specification. A preferred form of plug referred to in that earlier specification contained between 1.5% and 1.75% soluble sodium silicate by weight, whereas the preferred forms of plug for use with the present invention contain not less than 2.8% soluble sodium silicate by weight. The preferred type of soluble sodium silicate previously used (FG.112) contains 45.9% mean solids by weight, while the preferred type of soluble sodium silicate used for the present invention may contain a slightly greater proportion of means solids. A suitable material is that marketed by Messrs. Joseph Crossfield & Sons Ltd. of Warrington, England, under the reference 120, and containing 48.3% mean solids by weight. A material containing an even higher proportion may be used if desired by weight. In general the material preferably contains between 45% and 52% mean solids by weight.

Those stemming plugs that contain soluble sodium silicate are conveniently made by a method in which the silicate and sand are intimately mixed together and moulded into bodies of substantially cylindrical shape. The bodies are treated with carbon dioxide, which reacts with the sodium silicate to form a bonding agent for the sand and any other constituents. Some of the plugs described in the complete specification of the aforementioned British Pat. No. 988 763 were slightly tapered. The plugs in accordance with the present invention may also be so tapered, if desired, but they may equally well be truly cylindrical. Further, some of the earlier plugs were formed with blind axial holes. The plugs in accordance with the present invention may also be formed with such holes, though preferred plugs have no such holes. As is well known, articles made from sand bonded with sodium silicate treated with carbon dioxide become progressively stronger during a period following their manufacture. This process is referred to as curing, and is usually substantially complete in about five days, under normal conditions. The curing process can be hastened by heating the articles, but it is usually less expensive and more convenient to allow the articles to be cured naturally, without the application of heat. In practice the time that normally occurs between the manufacture of a stemming plug and its use in a mine or quarry exceeds five days, but if necessary the manufacturer may arrange for plugs to be stored for a period sufficient to ensure curing before they are despatched.

From yet another aspect, therefore, the present invention consists in a stemming plug for use in forming stemming by the method outlined above, the stemming plug comprising a self-supporting friable body consisting at least principally of sand bound with at least 2.8% by weight soluble sodium silicate containing between 45% and 52% mean solids, treated with carbon dioxide and caused or allowed to become cured.

A typical stemming plug embodying the present invention comprises a body of substantially cylindrical shape some four and a half or five inches long and between one and one and five eighths inches in diameter. A preferred form of plug is very slightly tapered, being one and seven sixteenths inches in diameter at one end and one and three eighths inches in diameter at the other end. Such a plug is suitable for use in a shot hole of the size normally used in coal mining. It is to be understood, however, that plugs of other sizes may well be employed, such as plugs of one and one eighth inches diameter for use in mines generally, and plugs of up to three and a half inches diameter for use in quarries.

A typical plug consists solely of the silicate binder and sand, or a mixture of sand with one or more other constituents such as marl and granular ceramic material, and sand remaining the major constituent. In manufacture the constituents are moulded to the desired shape and then treated with carbon dioxide which reacts with the sodium silicate to form a bonding agent for the sand. As mentioned above, a preferred form of plug has a soluble sodium silicate content of about 3.5% by weight. Although the soluble sodium silicate content may be increased to 5% by weight or even more, the plugs of those constituents are not of greatly increased strength, while the difficulty of mixing the constituents, the cost of increasing the sodium silicate content, and the necessary increase in time required for the treatment with carbon dioxide, normally make it undesirable to increase the soluble sodium silicate content much above 3.5%. After treatment with carbon dioxide the plugs are allowed to become cured during a period of at least five days.

The following test results illustrate the strength of plugs comprising 3.5% soluble sodium silicate by weight, and the remainder sand, the plugs being treated with carbon dioxide and allowed time to become cured. Each plug is five inches long and has a nominal outside diameter of one and three eighths inches. The plugs were packed in cartons made of thin card and having little innate strength. Each carton contained 50 plugs, the plugs in each carton being mutually parallel.

Test 1

A carton of plugs was dropped from a height of three feet onto a hard floor so as to strike the floor on a face of the carton parallel to the bases of the cores. None of the cores in the carton were broken.

Test 2

A carton of plugs was dropped from a height of three feet onto a hard floor so as to strike the floor on a face of the carton parallel to the axes of the cores.

| Results: | by weight of cores and core material | |
|---|---|---|
| | 52% unbroken cores<br>34% lengths of cores more than 2.5 inches long<br>12% lengths of cores between 1.7 and 2.5 inches long | all usable |
| | 2% crushed and unusable | |

Test 3

This test was similar to Test 2 but the carton was dropped from a height of five feet.

| Results: | by weight of cores and core material | |
|---|---|---|
| | 18% unbroken cores<br>60% lengths of cores more than 2.5 inches long<br>12% lengths of cores betweeen 1.7 and 2.5 inches long | all usable |
| | 10% crushed and unusable | |

Test 4

A carton of plugs was thrown from a height of three feet so as to roll several times and travel a distance of ten feet.

| Results: | by weight of cores and core material | |
|---|---|---|
| | 64% unbroken cores<br>30% lengths of cores more than 2.5 inches long<br>5% lengths of cores between 1.7 and 2.5 inches long | all usable |
| | 1% crushed and unusable | |

Test 5

A carton of plugs was thrown from a height of three feet so as to land on an edge parallel with the axes of the cores at a place ten feet from the place where it was thrown.

| Results: | by weight of cores and core material | |
|---|---|---|
| | 74% unbroken cores<br>24% lengths of cores more than 2.5 inches long | all usable |
| | 2% crushed and unusable | |

Nevertheless, after this type of plug is dipped in water and left for about two minutes it can then be crushed in a shot hole very readily and reliably.

The following table illustrates the speed with which the cores absorb water when they are immersed in it. The weights are in grammes.

| Plug No. | Dry Weight | Time Immersed | Weight of Water Absorbed | % Weight of Water Against Weight of Dry Plug |
|---|---|---|---|---|
| 1 | 183 | dipped | 51 | 28% |

-continued

| Plug No. | Dry Weight | Time Immersed | Weight of Water Absorbed | % Weight of Water Against Weight of Dry Plug |
|---|---|---|---|---|
| 2 | 177 | 5 secs. | 51 | 29% |
| 3 | 178 | 10 secs. | 50 | 28% |
| 4 | 177 | 15 secs. | 50 | 28% |
| 5 | 178 | 20 secs. | 50 | 28% |

It is understood that it is within the scope of the invention to wet the stemming plugs with aqueous liquids other than pure water should that be considered necessary or desirable.

Figure 2:
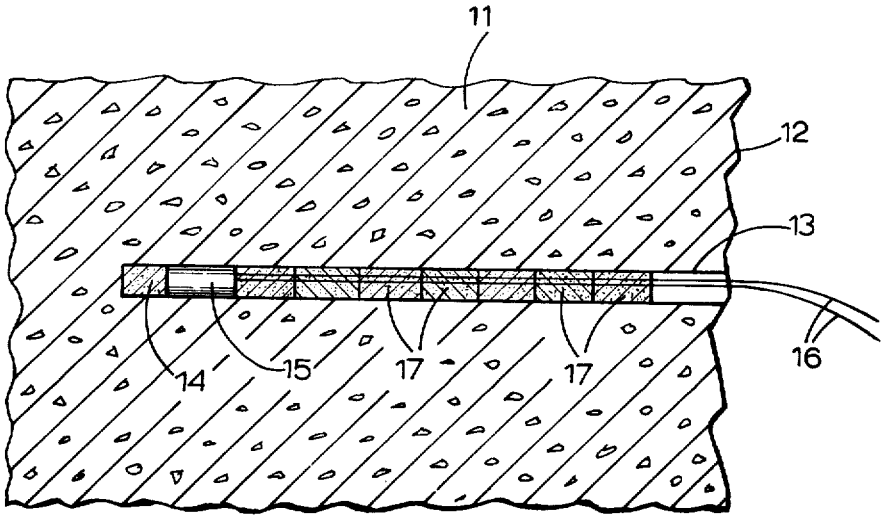

This invention is illustrated in the accompanying drawings, in which:

FIG. 1 is a perspective view of a stemming plug embodying the present invention, and FIG. 2 is a section through rock behind a rock face, and shows a shot hole containing an explosive charge and stemming embodying the present invention.

The plug 10 shown in FIG. 1 is formed in the manner outlined above and is five inches long and is very slightly tapered, being one and three eighths inches in diameter at one end and one and seven sixteenths inches in diameter at the other end.

FIG. 2 shows rock 11 behind a rock face 12, and a shot hole 13 extending into the rock from the face. Shot holes are usually of standard diameter, being drilled with a bit of one and eleven sixteenths inches diameter. In the formation of stemming a plurality of plugs are immersed in water for a short period and, after a delay of a few minutes, are used in the following manner. A plug is broken in half, and one half is pushed to the inner end of the shot hole 13 where it is crushed or disintegrated by means of a tamping rod. This crushed half plug is illustrated at 14. Should there happen to be a fissure at the inner end of the shot hole this is sealed by the crushed half plug 14. An explosive charge 15 with detonator, and detonator wires 16 are introduced into the hole next, with the detonator wires 16 leading from the hole. Stemming plugs 17 are then inserted into the hole one at a time, and each plug is crushed or disintegrated, using a tamping rod, before the next is inserted. As many plugs are inserted as are necessary to confine the shot adequately or to fill the shot hole.

In an alternative method several of the plugs or all of the plugs are inserted into the hole, and are then tamped together. When this is done it may happen that the innermost plug or innermost group of plugs is not fully crushed or disintegrated. This is not important, however, as the outermost plug or group of plugs is fully crushed or disintegrated and acts as a seal.

Whilst stemming and stemming plugs in accordance with the present invention may be used in connection with any form of mining or quarrying operation they have largely been development for use in coal mines and for use in the shotfiring of both coal and crut.

I claim:

1. A method of stemming comprising the steps of forming a stemming plug of a self-supporting body consisting at least principally of sand bound with the aid of sodium silicate, adding water to the stemming plug to weaken the same prior to its insertion into a shot hole, inserting said weakened plug into said shot hole and thereafter crushing or disintegrating said weakened plug in said shot hole.

2. A method according to claim 1 in which the plug is wetted by being immersed in water or other aqueous liquid at least until no more water is absorbed by it.

3. A method according to claim 1 in which a period of at least two minutes is allowed to elapse between the plug being wetted and it being crushed or disintegrated.

4. The method of claim 1 wherein the sodium silicate is soluble and comprises at least 2.8% by weight of the mixture of sand and sodium silicate, said sodium silicate containing between 45% and 52% mean solids, and including the step of treating said mixture with carbon dioxide until the sodium silicate reacts with the carbon dioxide to form a bonding agent for said sand, and thereafter allowing the resulting body to cure into a self-supporting friable body.

5. A method according to claim 4 in which the quantity of soluble sodium silicate is not more than 5% by weight.

6. A method according to claim 4 in ehich the quantity of soluble sodium silicate is about 3.5% by weight.

7. A method according to 4 substantially in the shape of a cylinder between one and one and five eighths inches in diameter.

* * * * *